US010317111B2

(12) United States Patent
Briglia et al.

(10) Patent No.: US 10,317,111 B2
(45) Date of Patent: Jun. 11, 2019

(54) METHOD AND APPARATUS FOR VAPORISING CARBON DIOXIDE-RICH LIQUID

(71) Applicant: L'Air Liquide, Société Anonyme pour l'Etude et l'Exploitation des Procédés Georges Claude, Paris (FR)

(72) Inventors: Alain Briglia, Hangzhou (CN); Arthur Darde, Paris (FR); Ludovic Granados, Puteaux (FR); Christophe Szamlewski, Combs la Ville (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 1191 days.

(21) Appl. No.: 14/413,655

(22) PCT Filed: Jul. 5, 2013

(86) PCT No.: PCT/FR2013/051608
§ 371 (c)(1),
(2) Date: Jan. 8, 2015

(87) PCT Pub. No.: WO2014/009641
PCT Pub. Date: Jan. 16, 2014

(65) Prior Publication Data

US 2015/0168025 A1 Jun. 18, 2015

(30) Foreign Application Priority Data

Jul. 13, 2012 (FR) ..... 12 56777

(51) Int. Cl.
*F17C 5/06* (2006.01)
*F17C 7/04* (2006.01)
(Continued)

(52) U.S. Cl.
CPC ..... *F25B 9/008* (2013.01); *F17C 5/06* (2013.01); *F17C 7/04* (2013.01); *F17C 13/021* (2013.01);
(Continued)

(58) Field of Classification Search
CPC ..... F17C 7/04; F17C 9/02–9/04
(Continued)

(56) References Cited

U.S. PATENT DOCUMENTS 6,786,053 B2 * 9/2004 Drube ..... F17C 5/06 62/50.2
2008/0110181 A1 5/2008 Werner
2008/0256959 A1 * 10/2008 Aspelund ..... F17C 9/00 62/48.1

FOREIGN PATENT DOCUMENTS

EP 0976969 A1 * 2/2000 ..... F17C 5/06
JP 2003120897 A * 4/2003

OTHER PUBLICATIONS

International Search Report and Written Opinion for PCT/FR2013/051608, dated Mar. 24, 2014.

* cited by examiner

*Primary Examiner* — Orlando E Aviles
*Assistant Examiner* — Antonio R Febles
(74) *Attorney, Agent, or Firm* — Justin K. Murray

(57) ABSTRACT

In a process for vaporizing a liquid stream rich in carbon dioxide wherein a liquid first stream rich in carbon dioxide is withdrawn from a chamber containing liquid rich in carbon dioxide and gas rich in carbon dioxide, the gas being at a pressure $P_1$, the liquid first stream is sent to a heat exchanger where it is vaporized, all the liquid from the first stream is vaporized in the heat exchanger at a pressure or several pressures greater than $P_1$, the vaporized first stream is extracted from the heat exchanger, expanded in a first
(Continued)

expansion valve and sent to the heat exchanger where it is heated.

15 Claims, 2 Drawing Sheets

(51) Int. Cl.
*F25B 1/00* (2006.01)
*F25B 9/00* (2006.01)
*F17C 13/02* (2006.01)

(52) U.S. Cl.
CPC ..... *F25B 1/00* (2013.01); *F17C 2205/0338* (2013.01); *F17C 2221/013* (2013.01); *F17C 2223/0153* (2013.01); *F17C 2223/033* (2013.01); *F17C 2223/035* (2013.01); *F17C 2223/043* (2013.01); *F17C 2223/046* (2013.01); *F17C 2225/0123* (2013.01); *F17C 2225/033* (2013.01); *F17C 2225/035* (2013.01); *F17C 2227/0121* (2013.01); *F17C 2227/0157* (2013.01); *F17C 2227/0302* (2013.01); *F17C 2227/0393* (2013.01); *F17C 2250/043* (2013.01); *F17C 2250/0408* (2013.01); *F17C 2250/061* (2013.01); *F17C 2250/0626* (2013.01); *F17C 2260/056* (2013.01); *F17C 2265/017* (2013.01); *F17C 2265/022* (2013.01)

(58) Field of Classification Search
USPC ..... 62/50.2
See application file for complete search history.

METHOD AND APPARATUS FOR VAPORISING CARBON DIOXIDE-RICH LIQUID

CROSS REFERENCE TO RELATED APPLICATIONS

This application is a § 371 of International PCT Application PCT/FR2013/051608, filed Jul. 5, 2013, which claims the benefit of FR1256777, filed Jul. 13, 2012, both of which are herein incorporated by reference in their entireties.

TECHNICAL FIELD OF THE INVENTION

The present invention relates to a process and an apparatus for vaporizing liquid rich in carbon dioxide.

BACKGROUND

One of the challenges of the cryogenic treatment of flows charged with $CO_2$ for separating the latter by partial condensation is to avoid suddenly freezing the liquid $CO_2$ that is generally found close to the triple point.

Indeed, in order to optimize the separation energy and above all the $CO_2$ recovery yield, it is advisable to cool the mixture from which it is desired to extract the $CO_2$ as cold as possible. The physical limit that appears is that of the solidification temperature of the liquid obtained by partial condensation.

In the prior art, it was known to vaporize the liquid $CO_2$ at the lowest possible pressure in order to provide the cold needed for the partial condensation. Thus, liquid $CO_2$ that is almost pure is vaporized at a pressure as close as possible to the triple point since it is in this way that the coldest temperature is generated. The vaporized $CO_2$ is heated and compressed in order to serve as cycle molecules (in the case of a $CO_2$ liquefier) or in order to be exported as product or for both applications.

This process is efficient since it permits a high $CO_2$ recovery yield at a relatively low energy cost (compared to the alternatives). It also offers the possibility of not introducing other coolant gases onto the site, especially in the context of a $CO_2$ liquefier.

The main drawback is that, in the case of depressurization of zones containing liquid $CO_2$, and mainly of the zone corresponding to the vaporization of the $CO_2$ at low pressure which is closest to the triple point, there is a risk of rapidly expanding the liquid with production of two phases: solid and gaseous. Specifically, the $CO_2$ phase diagram prohibits the liquid phase at a pressure of less than 5.1 bar approximately.

This solid $CO_2$ could block the pipes and especially the channels of a plate exchanger. Moreover, the sublimation or melting of this solid $CO_2$ will be difficult since assuming that a liquid or solid fraction is trapped between two plugs of ice, the change of state could lead to the equipment breaking via overpressure. This risk during heating is accentuated by the fact that $CO_2$ ice (solid $CO_2$) is denser than liquid $CO_2$, thus, during freezing, there is little chance of breaking equipment (unlike what happens with water).

SUMMARY OF THE INVENTION

In certain embodiments, the invention aims to protect the equipment that is the most sensitive to the presence of solid $CO_2$, namely the pipes and above all the brazed aluminum exchanger, where the hydraulic diameters are very small (of the order of a few millimeters).

The principle is to raise the vaporization pressure of the liquid in the exchanger and to mechanically ensure that if the pressure of the system drops, the freezing will begin anywhere other than in the zones with small hydraulic diameters.

According to one subject of the invention, a process is provided for vaporizing a liquid stream rich in carbon dioxide wherein a liquid first stream rich in carbon dioxide is withdrawn from a chamber containing liquid rich in carbon dioxide and gas rich in carbon dioxide, the gas being at a pressure P1, the liquid first stream is sent to a heat exchanger where it is vaporized, all the liquid from the first stream being vaporized in the heat exchanger at a pressure or several pressures greater than P1, the vaporized first stream is extracted from the heat exchanger, expanded in a first expansion valve and sent to the heat exchanger where it is heated, characterized in that the liquid level in the chamber is located at a higher level above the ground than the level at which the last drop of liquid rich in carbon dioxide is vaporized in the exchanger, the difference between the two levels being H.

According to other optional subjects of the invention:

- H is at least equal to 2 m, preferably at least equal to 5 m;
- gas from the chamber is heated in the heat exchanger;
- the vaporized stream expanded in the valve is mixed with the gas from the chamber and heated in the heat exchanger;
- the vaporized stream expanded in the valve is sent to the chamber;
- the vaporized stream expanded in the first valve and heated in the heat exchanger leaves the heat exchanger, is expanded in a second expansion valve and sent to a compressor in order to be compressed;
- a liquid second stream rich in carbon dioxide at a pressure greater than that at which the first stream leaves the chamber is vaporized in the heat exchanger and is sent to an intermediate level of the compressor, the vaporized first stream being sent to the inlet of the compressor;
- a portion of the vaporized liquid second stream is expanded and sent to the inlet of the compressor.

According to another subject of the invention, an apparatus is provided for vaporizing a liquid stream rich in carbon dioxide comprising a chamber containing liquid rich in carbon dioxide and gas rich in carbon dioxide, the gas being at a pressure P1, a heat exchanger, a duct for withdrawing a liquid first stream rich in carbon dioxide from the chamber and that is connected to the heat exchanger, pressurization means for increasing the pressure of all the liquid of the first stream to at least one vaporization pressure greater than P1, a duct for extracting the vaporized first stream from the heat exchanger that is connected to a first expansion valve in order to expand the vaporized first stream in order to form an expanded stream and a duct for sending the expanded stream to the heat exchanger, characterized in that the liquid level in the chamber is located at a higher level above the ground than the level at which the last drop of liquid rich in carbon dioxide is vaporized in the exchanger, the difference between the two levels being H.

According to other optional subjects of the invention:

- H is at least equal to 2 m, preferably at least equal to 5 m;
- a duct for sending gas from the chamber to be heated in the heat exchanger;

means for mixing the vaporized stream expanded in the valve with the gas from the chamber heated in the heat exchanger;

the vaporized stream expanded in the valve is sent to the chamber;

a duct for extracting, from the heat exchanger, the vaporized stream expanded in the first valve and heated in the heat exchanger, which duct is connected to a second expansion valve and to a compressor;

means for sending a liquid second stream rich in carbon dioxide at a pressure above that at which the first stream leaves the chamber to be vaporized in the heat exchanger and a duct for sending the vaporized liquid second stream to an intermediate level of the compressor, the vaporized first stream being sent to the inlet of the compressor;

means for expanding a portion of the vaporized liquid second stream connected to the inlet of the compressor.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
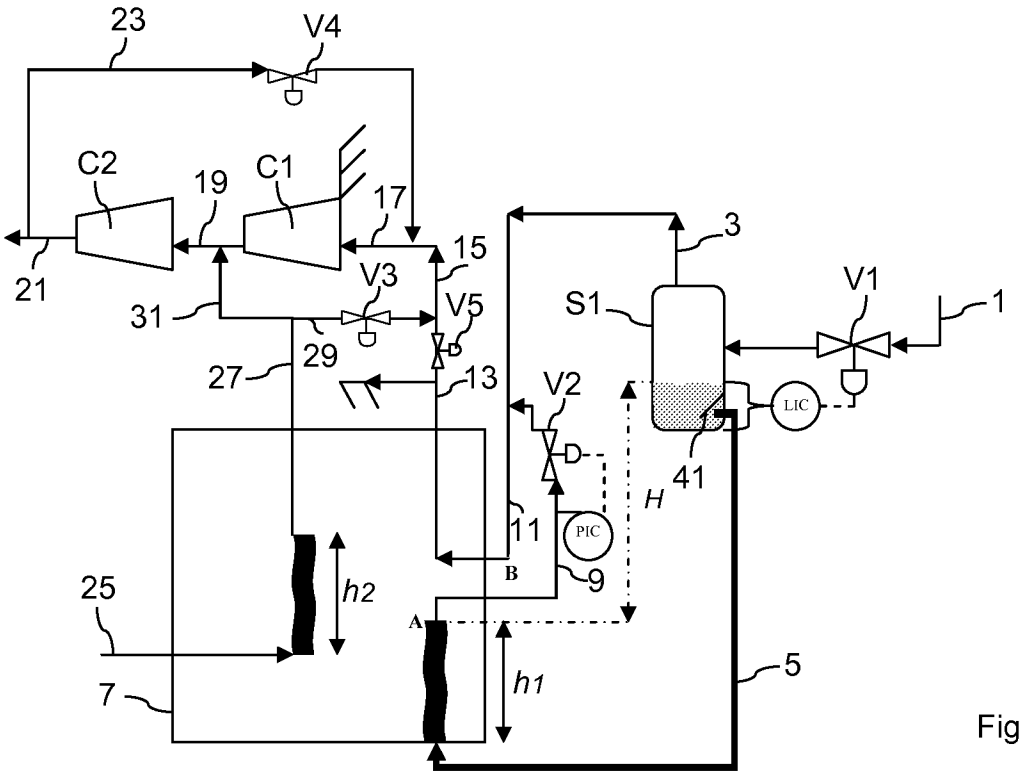
FIG. 1 provides an embodiment of the present invention.

The invention will be described in greater detail by referring to FIG. 1 which represents a process according to the invention and FIG. 2 which represents a detail of FIG. 1.

A liquid stream rich in carbon dioxide 1 is expanded in a valve V1 and sent to a phase separator S1. Here, a gas 3 rich in carbon dioxide is separated from a liquid rich in carbon dioxide 5, the liquid remaining partly in the chamber of the phase separator S1 with a liquid level. The gas 3 is at a pressure P1. A liquid rich in carbon dioxide 5 is withdrawn from the phase separator S1 at a pressure above P1, owing to the bath of liquid in the phase separator and descends to the lowest level of a brazed aluminum plate heat exchanger 7. The height travelled raises its pressure even more. The liquid 5 is vaporized in a passage of the heat exchanger that forms a liquid column. In this column, the liquid is vaporized gradually, the last drop of liquid vaporizing at a point A, at a level h1 above the bottom of the heat exchanger. Thus, the liquid column has a height h1. The difference in height between the level A and the liquid level in the chamber S1 is equal to H, H being greater than 1 m, or even greater than 5 m.

The vaporized liquid 9 leaves the exchanger slightly after the level A and is expanded in a valve V2, for example to the pressure P1. As can be seen in the appended diagram, the addition of the valve V2 after the vaporization of $CO_2$ at low pressure makes it possible to raise the pressure of liquid $CO_2$ in the exchanger. This pressure drop may be used to raise the phase separator S1 containing the standard reserve of liquid supplying the vaporization of $CO_2$ at low pressure and thus to reduce its pressure with respect to the pressure experienced in the exchanger 7. A hydrostatic height H of 6 meters leads to around 600 mbar of pressure difference, i.e. around 10% of the 5.1 bar of the triple point.

The gas expanded in the valve V2 is sent back to the exchanger 7 to a level B above A, heated and leaves the exchanger 7 as stream 13. The stream 13 may be expanded in a valve V5 or may short-circuit the latter. This stream 13 that has become 15 is sent to a first stage C1 of a compressor, compressed in order to form a stream 19, compressed in a second stage C2 of the compressor and produced as product 21 which is a gas rich in carbon dioxide.

The gas 3 originating from the phase separator S1 is mixed with the vaporized stream 9 downstream of the expansion valve V2.

If the compressor C1, C2 treating the $CO_2$ vaporized at low pressure runs away and sucks up too much $CO_2$, every pressure upstream will drop. The pressure in the exchanger 7 will therefore decrease, but before it reaches the pressure of the triple point (leading to the formation of carbon dioxide snow), the pressure of the phase separator S1 will reach this pressure and liquid will expand in order to form solid and a gas phase. The approximate proportions of the products are one third gas and two thirds solid. This gas fraction will supply the intake of the compressor C1, C2 and thus give a little more time for reducing the suction rhythm thereof before having converted all the liquid from the phase separator S1 into solid and gas.

Specifically, the pressure of the phase separator S1 will remain at the pressure of the triple point, as long as not all of the liquid has been converted to solid and gas. The most well-known analog relates to a boiling liquid: as long as not all of the liquid phase has evaporated, the temperature does not rise irrespective of the heating. On the other hand, when the liquid level of the phase separator S1 drops, the zone at the pressure of the triple point drops. In practice, the pressure of the triple point must be found at the liquid-gas interface, therefore at steady (non-turbulent) state, at the surface, since the weight of the liquid increases the pressure upon sinking below the surface. When this interface drops in the pipe for supplying liquid 5 of the exchanger 7, the pressure in the latter also drops, since the hydrostatic height decreases (height H in the figure below), coming closer then to the appearance of the solid phase in the exchanger 7.

It will also be noted that the $CO_2$ vaporized at low pressure 9 is not returned to the phase separator S1 by default and as illustrated since if the $CO_2$ 5 contains heavy elements (NOx, hydrocarbons, etc.) which would not be completely vaporized, returning the vaporized phase (thermosiphon operation) to the separator S1 would lead to the accumulation of these heavy elements in the liquid.

On the other hand, the $CO_2$ 5 is pure or at best free of heavy elements, it is possible to envisage taking the vaporized $CO_2$ 9 back to the phase separator S1 from where the gas fraction 3 escapes at the top. The advantage is then that the risk of sending liquid $CO_2$ to the hot end of the exchanger E1 when heat is not available in a sufficient quantity for the vaporization of all the liquid, is reduced.

It is advisable to position the liquid outlet 5 of the phase separator S1 so as to avoid entraining $CO_2$ ice cubes if they are formed in the separator S1. A protective grid or a deflector plate could serve the purpose, combined with the fact that the liquid sampling does not take place at a low point. It should be remembered in this regard that the $CO_2$ ice cubes will flow in the liquid (unlike the ice from water).

Other ways for helping the pressure in the separator S1 not to drop too rapidly exist:

a. sending back a portion 29 of the $CO_2$ 25 vaporized at higher pressure to the intake of the $CO_2$ at low pressure (valve V3);

b. addition of a valve V5 that makes it possible to increase the pressure difference between the phase separator S1 and the intake of the compressor C1, C2, this makes it possible to give oneself a little more time to react in the event of a pressure drop at the intake of the compressor, it is thus possible to gradually close this valve when the pressure drops;

c. the use of anti-pumping of the compressor C1, C2 in order to stabilize its intake pressure (valve V4);

d. the use of IGVs (Inlet Guide Vanes) for regulating the intake flow rate.

The measurements indicated above (including the main subject of the invention), all lead to an increase of the specific energy for treatment of the $CO_2$, either continuously (in case of valves V2 and V5 that increase the vaporization temperature in the exchanger and therefore reduce the $CO_2$ recovery yield since the gas treated is cooled less), or in a one-off manner (in the case of valves V3 or V4, optionally V5 if it is only used in a one-off manner).

The control alone relating to the IGVs affects only very marginally the energy by moving the compressor away from its optimal operating point. However the drawback of this control is that it is slow (several tens of seconds) and not very reactive and therefore above all suitable for long controls when provision is made to change the feedstock of the unit for example.

In keeping with the invention that consists in reducing the risk of freezing in the zones close to the triple point, a novel invention consists in improving the energy of the system thus obtained.

Figure 2:
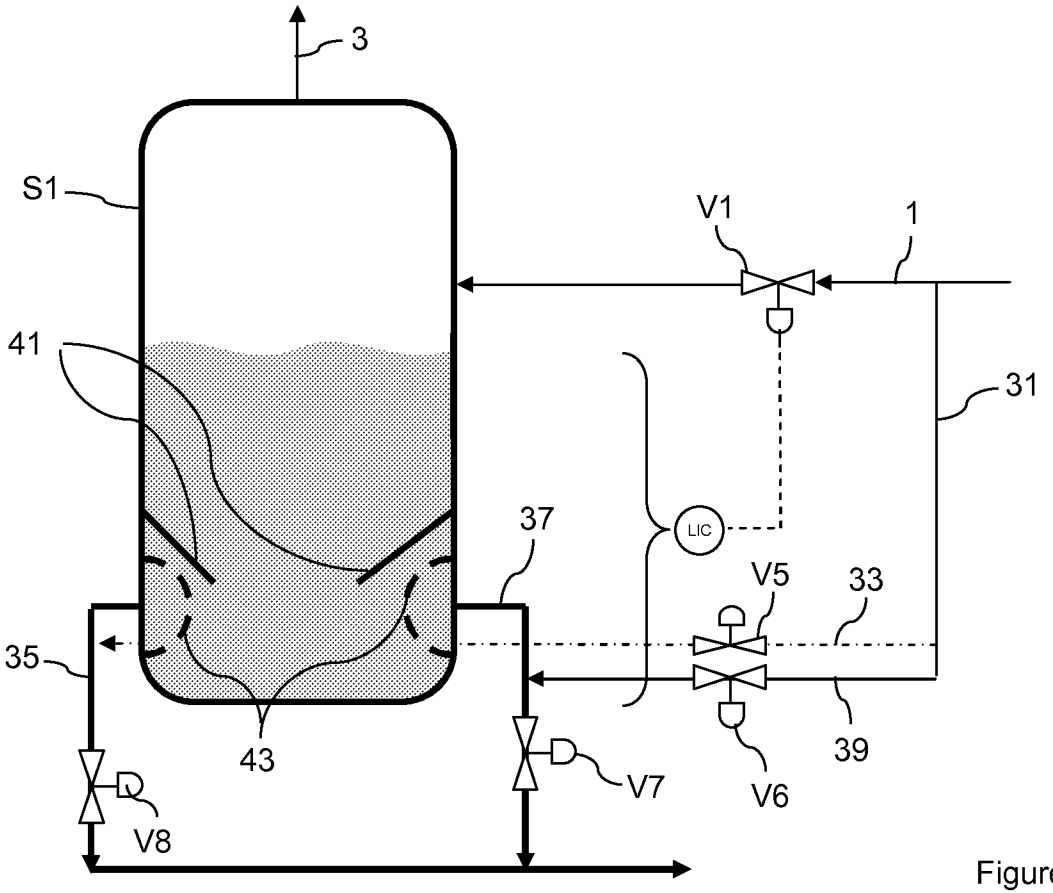
FIG. 2 provides further detail of an embodiment of the present invention.

FIG. 2 shows the phase separator S1 and its connections in greater detail. The liquid stream rich in carbon dioxide 1 is expanded in the valve V1 and sent to the phase separator S1. Here, a gas 3 rich in carbon dioxide is separated from a liquid rich in carbon dioxide 5, the liquid remaining partly in the chamber of the phase separator S1 with a liquid level. The gas 3 is at a pressure P1. A liquid rich in carbon dioxide 5 is withdrawn from the phase separator S1 at a pressure above P1, owing to the bath of liquid in the phase separator.

The opening of the valve V1 is controlled by the liquid level in the phase separator S1.

Provision is made to operate continuously with the phase separator S1 at the pressure of the triple point. There will thus constantly be concomitance of the three phases. The pressure of the phase separator S1 will thus be stabilized since as long as it contains liquid and solid, the pressure will not be able to move away from that of the triple point. The pressure at the intake of the compressor will thus be stabilized. If it sucks up too much, solid will be created in the separator S1 by rapid formation from liquid to solid and gas. If it does not suck up enough, the level of the separator S1 will have a tendency to rise and the supply valve V1 will close.

This makes it possible to reduce the vaporization pressure in the exchanger 7 since it differs from that of the separator S1 by a fixed value linked to the hydrostatic height.

It is then necessary to ensure that the carbon dioxide snow from the separator S1 is not entrained toward the exchanger 7. Let it be remembered that carbon dioxide snow is denser than the liquid and therefore has a tendency to flow. Moreover, it is likely that this carbon dioxide snow is present in the form of suspended crystals of small size.

A deflector plate 41 and grid 43 system, combined with a lateral liquid sampling point 35, 37 will help to avoid entraining most of the solid.

The liquid outlets 35, 37 are connected to the vertical wall of the phase separator and not to the bottom. The liquid withdrawn via the duct 35 and the open valve V8 and the liquid withdrawn via the duct 37 and the open valve V7 are mixed in order to form the liquid stream 5.

The grids 43 are installed around liquid outlets to prevent the solid from exiting. A deflector plate is installed above each outlet 35, 37 to prevent the solid dropping toward the outlet.

However, as the general movement of the liquid will be a flow toward the liquid outlet, the ice floating at mid-level will probably accumulate on the protective grid.

One proposition for preventing this problem is to have two or more liquid sampling points 35, 37 that are apart from one another. When the pressure drop increases across one of the sampling points, this sampling point closes and the other one (or another one) opens. The flow of liquid will therefore change and free the blocked grid. One possibility is to send liquid via the duct 31, 39 and the open valve V6 in order to pass through the duct 37 going toward the phase separator and to return via the grid 43. It is also possible, if this is not sufficient, to envisage injecting liquid $CO_2$ at higher pressure from the other side of the blocked grid, via a dedicated line 31, 33 originating from the feed of the phase separator S1 by opening the valve V15.

Finally, an optimized management of the various liquid sampling points, combined with the measurement of the pressure drops of each device will make it possible to confine the carbon dioxide snow in the pot.

According to this invention, a liquid rich in carbon dioxide contains at least 75 mol % of carbon dioxide, or at least 85 mol % of carbon dioxide, or even at least 95 mol % of carbon dioxide.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value.

When such particular value and/or to the other particular value, along with all combinations within said range.

All references identified herein are each hereby incorporated by reference into this application in their entireties, as well as for the specific information for which each is cited.

The invention claimed is:

1. A process for vaporizing a liquid stream rich in carbon dioxide, the method comprising the steps of:

withdrawing a liquid first stream rich in carbon dioxide from a chamber containing liquid rich in carbon dioxide and gas rich in carbon dioxide, the gas being at a pressure $P_1$;

sending the liquid first stream to a heat exchanger and vaporizing the liquid first stream in the heat exchanger at a pressure at or above $P_1$ to form a vaporized first stream, the heat exchanger comprising a vaporization level located at the location at which the last drop of liquid rich in carbon dioxide vaporized in the heat exchanger;

extracting the vaporized first stream from the heat exchanger;

expanding the vaporized first stream in a first expansion valve to form an expanded first stream; and heating the expanded first stream in the heat exchanger, wherein the liquid level in the chamber is located at a higher level above the ground than the vaporization level of the heat exchanger, the difference between the two levels being H.

2. The process as claimed in claim 1, wherein H is at least equal to 2 m.

3. The process as claimed claim 1, wherein gas from the chamber is sent to the heat exchanger to be heated.

4. The process as claimed in claim 3, wherein the vaporized stream expanded in the first valve is mixed with the gas from the chamber and heated in the heat exchanger.

5. The process as claimed in claim 3, wherein the vaporized stream expanded in the first valve is sent to the chamber.

6. The process as claimed in claim 1, wherein the vaporized stream expanded in the first valve and heated in the heat exchanger leaves the heat exchanger, is expanded in a second expansion valve and sent to a compressor in order to be compressed.

7. The process as claimed in claim 6, wherein a liquid second stream rich in carbon dioxide at a pressure greater than that at which the first stream leaves the chamber is vaporized in the heat exchanger and is sent to an intermediate level of the compressor, the vaporized first stream being sent to the inlet of the compressor.

8. The process as claimed in claim 7, wherein a portion of the vaporized liquid second stream is expanded and sent to the inlet of the compressor.

9. An apparatus for vaporizing a liquid stream rich in carbon dioxide, the apparatus comprising:

a chamber configured to contain liquid rich in carbon dioxide and gas rich in carbon dioxide, the gas being at a pressure $P_1$;

a heat exchanger in fluid communication with the chamber, such that the heat exchanger is configured to receive a liquid first stream rich in carbon dioxide from the chamber;

pressurization means for increasing the pressure of all the liquid of the first stream to at least one vaporization pressure greater than $P_1$; and a duct configured to extract the vaporized first stream from the heat exchanger that is connected to a first expansion valve in order to expand the vaporized first stream in order to form an expanded stream and a second duct configured to send the expanded stream to the heat exchanger, wherein the liquid level in the chamber is located at a higher level above the ground than the level at which the last drop of liquid rich in carbon dioxide is vaporized in the exchanger, the difference between the two levels being H.

10. The apparatus as claimed in claim 9, wherein H is at least equal to 2 m.

11. The apparatus as claimed in claim 9, comprising a third duct configured to send gas from the chamber to be heated in the heat exchanger.

12. The apparatus as claimed in claim 11, comprising means for mixing the vaporized stream expanded in the first valve with the gas from the chamber heated in the heat exchanger.

13. The apparatus as claimed in claim 9, comprising a fourth duct configured to extract, from the heat exchanger, the vaporized stream expanded in the first valve and heated in the heat exchanger, which fourth duct is connected to a second expansion valve and to a compressor.

14. The apparatus as claimed in claim 13, comprising means for sending a liquid second stream rich in carbon dioxide at a pressure above that at which the first stream leaves the chamber to be vaporized in the heat exchanger and a fifth duct configured to send the vaporized liquid second stream to an intermediate level of the compressor, the vaporized first stream being sent to the inlet of the compressor.

15. The apparatus as claimed in claim 13, comprising expansion means for expanding a portion of the vaporized liquid second stream connected to the inlet of the compressor.

* * * * *